United States Patent [19]
Furedi et al.
[11] 4,318,314
[45] Mar. 9, 1982

[54] RATCHET WRENCH ASSEMBLY

[76] Inventors: Ervin J. Furedi, 223 Pleasant Grove Rd., Long Valley, N.J. 07853; Richard E. Blodgett, 24 Holmesbrook Rd., Basking Ridge, N.J. 07920

[21] Appl. No.: 83,380

[22] Filed: Oct. 10, 1979

[51] Int. Cl.[3] ..... B25B 17/00
[52] U.S. Cl. ..... 81/57.29; 192/41 S; 81/58
[58] Field of Search ..... 81/57.29, 57.39, 58; 192/41 S, 43, 51; 145/75, 76

[56] References Cited

U.S. PATENT DOCUMENTS

| | | | |
|---|---|---|---|
| 1,704,062 | 3/1929 | Starkey | 192/41 S |
| 3,372,781 | 3/1968 | Fulton | 192/43 |
| 4,086,829 | 5/1978 | Hudgins | 81/57.29 |

FOREIGN PATENT DOCUMENTS

| | | | |
|---|---|---|---|
| 433366 | 4/1948 | Italy | 192/41 S |

*Primary Examiner*—James L. Jones, Jr.
*Attorney, Agent, or Firm*—William T. Hough

[57] ABSTRACT

There is disclosed a novel ratchet wrench assembly comprised of a barrel assembly including a clutching mechanism positioned for rotational movement about a drive shaft of the ratchet wrench assembly including a drive stud and gear assembly. The clutching mechanism of the barrel assembly is interconnected to the drive shaft whereby rotation of the barrel assembly about the axis of the drive shaft in either direction causes the drive shaft to rotate in response thereto and thereby rotate the drive stud through the drive stud and gear assembly in a responsive rotational direction. In a preferred embodiment of the present invention, the clutching mechanism is designed such that the rotational movement of the barrel assembly and the drive stud are coincident, i.e. counter-clockwise rotational movement of the barrel assembly results in a counter-clockwise rotational movement of the drive stud, and thus loosening of a bolt or nut mounted on a right hand threaded stud, and visa-versa.

6 Claims, 9 Drawing Figures

52
56
42
44
54

42
54
58
56
44
52
48

10
12
16
18
188
184
4
20
38
32
36
52
20
42
26
54
60
60a
60b
62a
62b
28
30
64
66
68
70

RATCHET WRENCH ASSEMBLY

This invention relates to a ratchet wrench assembly, and more particularly to a novel ratchet wrench assembly for the readily and facile unthreading or threading of a loosened bolt or nut from a threaded shaft therefor.

BACKGROUND OF THE INVENTION

When unthreading a bolt, a ratchet wrench works well as long as there is some resistance to rotation of the bolt or nut in the direction opposite to the direction of movement of the wrench shaft from that of the unthreading motion. In order to continue to unthread the bolt or nut using such a ratchet wrench under such circumstances, some resistance must be applied to the socket lest the nut or bolt simply reciprocally rotate in response to the forward and backward movement of the ratchet wrench.

In U.S. Pat. No. 735,134 to MacLean and U.S. Pat. No. 2,703,030 to Marvin, there are disclosed devices designed to overcome the problems of rotating loosened bolts wherein there is provided a rotating shaft positioned within a wrench handle and driven by a crank shaft engageable with a gear member mounted about or positioned on a drive stud of the drive stud assembly. In order to effect rotation of such a drive stud, it is necessary to use two hands, i.e. one hand to firmly grasp and anchor the wrench handle in fixed position and the other hand to cause the shaft to engage the gear member associated with the drive stud and to subsequently rotationally drive the crank shaft thereby to rotate the loose bolt. In U.S. Pat. No. 4,128,025 to Nairn, there is primarily disclosed a ratchet wrench assembly including a two positionable drive assembly for rotating the drive stud for starting or removing loose bolts in one position and for rotating the ratchet wrench through a ratcheting device in the other position. Such an assembly similarly requires a two-handed operation in the position for starting or removing loosened bolts.

OBJECTS OF THE INVENTION

It is an object of the present invention to provide a novel ratchet wrench assembly for the facile starting or removal of loose bolts by a one-handed operation.

Another object of the present invention to provide a novel ratchet wrench assembly which does not require axially movement to a gear drive assembly to effect engagement between a gear mounted for rotation with the drive stud assembly and a drive gear shift therefor.

A further object of the present invention is to provide a novel ratchet wrench assembly which does not require a secondary operation to engage the drive stud and gear assembly.

Still another object of the present invention is to provide a novel ratchet wrench assembly which is manufactured in a facile manner.

SUMMARY OF THE INVENTION

These and other objects of the present invention are achieved by a novel ratchet wrench assembly comprised of a barrel assembly including a clutching mechanism positioned for rotational movement about a drive shaft of the ratchet wrench assembly including a stud drive and gear assembly. The clutching mechanism of the barrel assembly is connected to the drive shaft whereby rotation of the barrel assembly about the axis of the drive shaft in either direction causes the drive shaft to rotate in response thereto and thereby rotate the drive stud through the stud drive and gearing assembly in a responsive rotational direction as more clearly hereinafter described. The clutch assembly, however, has the feature that a rotational force applied to the drive stud and hence to the drive shaft through the gear assembly is not transmitted to the barrel. In a preferred embodiment of the present invention, the clutching mechanism is designed such that the rotational movement of the barrel assembly and the drive stud are coincident, i.e. counterclockwise rotational movement of the barrel assembly results in a counterclockwise rotational movement of the drive stud, and thus loosening of a bolt or nut mounted on a right hand threaded stud and visa-versa.

BRIEF DESCRIPTION OF THE DRAWINGS

Understanding of the present invention will be facilitated by referring to the following detailed description when taken in conjunction with the accompanying drawings, in which.

DETAILED DESCRIPTION OF THE INVENTION

Figures 1, 2, 3:
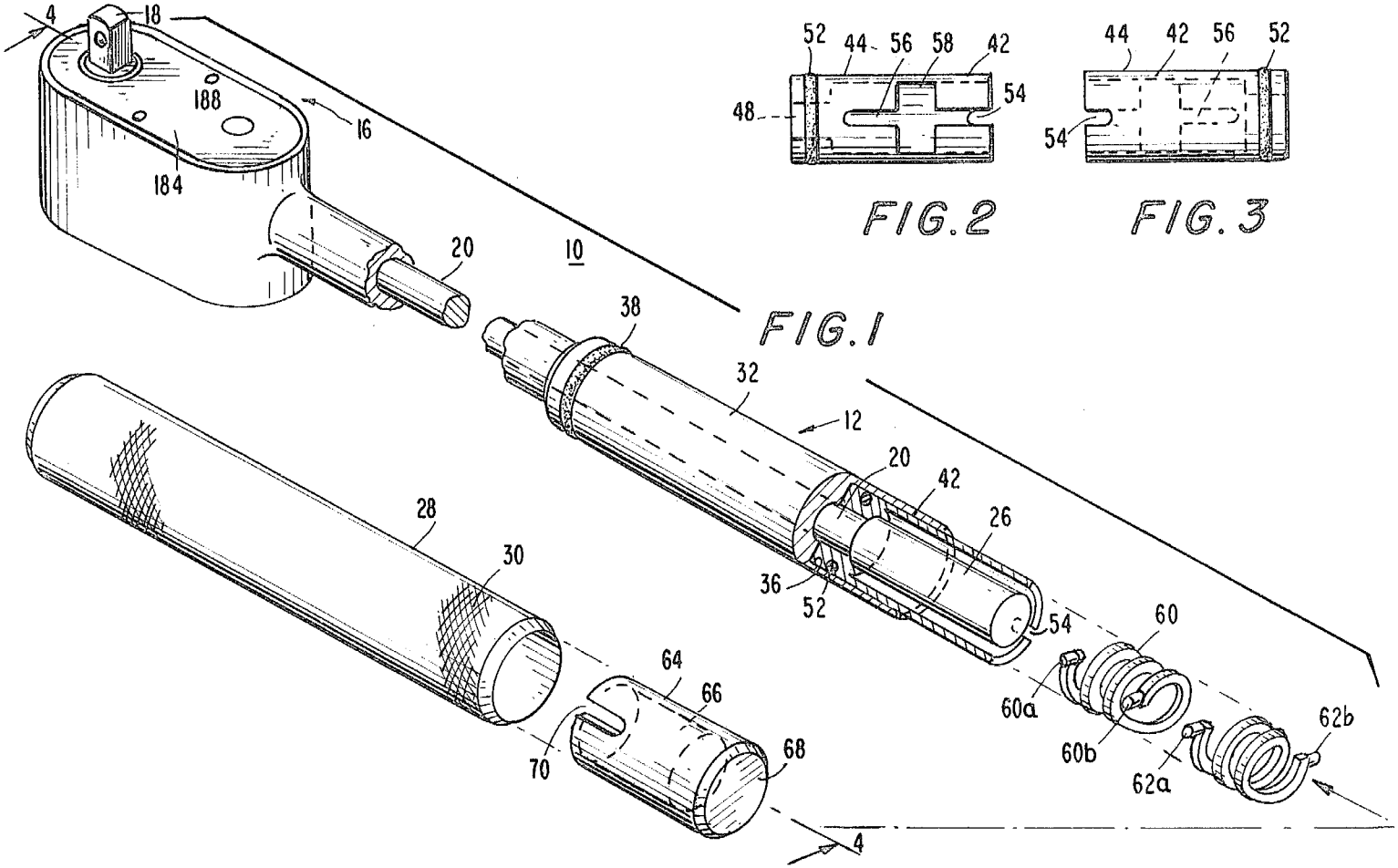
FIG. 1 is an exploded isometric view of the novel ratchet assembly of the present invention particularly illustrating the clutching mechanism.
FIG. 2 is a front elevational view of a sleeve member of the clutching mechanism.
FIG. 3 is a rear elevational view of the sleeve member of FIG. 2.
Figure 4:
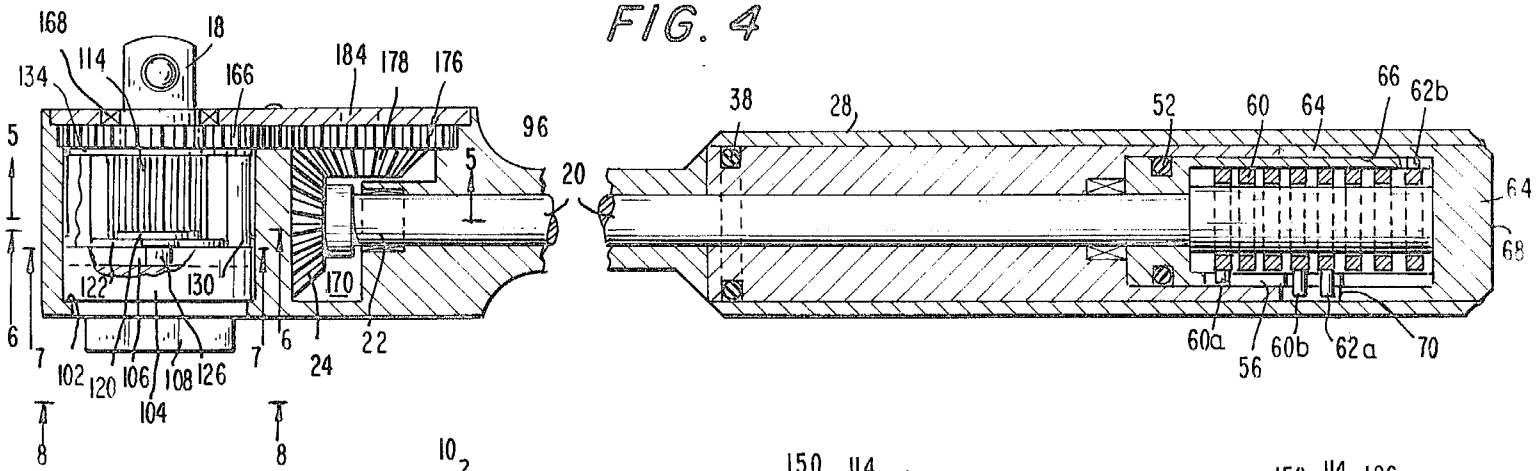
FIG. 4 is a cross-sectional view of the novel ratchet wrench assembly of the present invention.

Referring now to the drawings, there is illustrated the novel ratchet wrench assembly of the present invention, generally indicated as 10, and comprised of a handle and barrel assembly, generally indicated as 12, mounted for rotation about one end of a drive shaft 14 having a stud drive and gear assembly, generally indicated as 16, including an elongated drive stud 18 rotatably mounted on the stud drive and gear assembly 16 for connection with socket tools (not shown).

The drive shaft 20 is comprised of a cylindrically-shaped shaft section 20 having an end portion 22 for receiving in secured relationship a miter gear 24 and formed at the other end thereof with an enlarged cylindrically-shaped end portion 26.

The handle and barrel assembly 12 is comprised of a cylindrically-shaped handle 28 having an outer knurled surface 30 mounted about a cylindrically-shaped shaft housing member 32 formed with a centrally-disposed, cylindrically-shaped elongated drive shaft passageway 34 and a cylindrically-shaped end chamber 36. The drive shaft chamber 34 of the shaft housing member 32 is dimensioned to permit rotation of the drive shaft 14 within the shaft housing member 32 with a bearing 37.

A portion of the outer surface of the shaft housing member 32 towards the stud drive and gear assembly 16 is provided with a circular-U-shaped groove 38 to receive an O-ring 40 to minimize dirt accumulation.

Positioned for rotation within the end chamber 36 of the shaft housing member 32, there is provided a cylindrically-shaped spring housing 42 having an outer surface 44, an inner spring chamber portion 46, and a centrally-disposed drive shaft passageway 48 dimensioned to permit of rotation of the drive shaft 14 within the spring housing 42. An end of the spring housing 42 corresponding to the end housing the shaft passageway 48, there is provided on the outer surface 44 thereof, a circular-U-shaped groove 50 having an axis substantially perpendicular to the axis of the drive shaft 14 and in which there is disposed a friction O-ring 52, as more fully hereinafter described. The spring housing 42 is formed at the other end thereof with elongated slots 54 and 56 parallel to the axis thereof, one of which slots is relatively short and the other of which is substantially longer, the slots 54 and 56 being formed on diametrically opposite portions of the spring housing 42. Intermediate and perpendicular to the longer slot 56, there is formed an elongated slot 58 of a width substantially larger than the slots 54 and 56.

About the end portion 26 of the drive shaft 14 and within the chamber 46 of the spring housing 42, there are positioned helical springs 60 and 62 of right hand thread types, each of which helical springs are formed with radially upturned end portions 60*a* and 60*b* and 62*a* and 62*b*, respectively, with the end portions 60*a*, 60*b* and 62*a* being aligned with one another whereas end portion 62*b* is disposed at an angle of 180° therefrom. The helical springs 60 and 62 are positioned within the spring housing 42 such that end portion 60*a* of the helical spring 60 is positioned within the slot 56 juxtaposed to the end portion of the spring housing 42 having the friction ring assembly 50 while the other end 60*b* of the helical spring 60 is disposed within the open area defined by the slots 56 and 58, and the end 62*a* of the helical spring 62 is likewise disposed within such open area defined by the slots 56 and 58 while the other end 62*b* is disposed within the slot 54.

The helical springs 60 and 62 are held in place within the spring housing 42 by a cylindrically-shaped spring clamp sleeve member 64 press fitted to the inner surface of the handle 28 and in rotational relationship to the outer surface of the spring housing 42. The sleeve member 64 is formed with an inner chamber 66 enclosed by an end wall 68 and with an elongated slot 70 parallel to the axis of the sleeve member 64. The upturned end portions 60*b* and 62*a* of the springs 60 and 62 are preferably spot welded within the slot 70 to the spring clamp sleeve member 64. The helical springs 60 and 62 are dimensioned to slide over the end portion 26 of the drive shaft 14 and engage such end portion 26 of the shaft 14, as more fully hereinafter described. Additionally, the number of turns of the spring are selected such that the tightening of a spring 60 or 62 about the end portion 26 of the shaft 14 places a torsional force on the drive shaft 14 until a torque in excess of about 5 foot pounds is reached whereupon the spring is caused to slip over such end portion 26.

The drive stud and gear assembly 16, referring more particularly to FIGS. 4 to 9 is comprised of an elongated housing, generally indicated as 90, formed with a rachet assembly receiving portion and gear assembly portion, generally indicated as 92 and 94, respectively, and having a drive shaft receiving portion 96 including a cylindrically-shaped drive shaft passageway 98. The rachet assembly receiving portion 92 is formed of a generally cylindrically-shaped chamber 100 including a spline portion 101 and with a lower end wall 102 for positioning for rotational movement a ratchet direction disc member 104 formed with an inner slotted channel 106 and outer elongated gripping member 108. Positioned above the disc member 104 is a rachet drive assembly, generally indicated as 110, comprised of a cylindrically-shaped housing member 112, a semi-circularly shaped pawl member 114 having upwardly extending leg member 116 and 118, a disc-shaped retaining member 120, a disc-shaped rotation direction changing member 122 including an intermediate raised contact portion 124, a spring 126 and a positioning spring 128.

The housing member 112 is formed with a lower cylindrically-shaped portion 130 from which extends a centrally-disposed shaft 132, a circularly-shaped bearing portion 134, a circularly-shaped gear receiving portion 136 and the socket stud 18. The lower cylindrically-shaped portion 130 is formed with a partial cylindrically-shaped chamber 138 including a transversely-disposed cylindrically-shaped chamber 140 and with a vertically-disposed cylindrically shaped chamber 142, referring in particular to FIG. 5. The spring 126 is positioned within the cylindrically-shaped chamber 140 for spring loading the pawl member 114 with the legs 116 and 118 extending from the chamber 138. The disc-shaped retaining member 120 including a centrally formed shaft orifice 144, spring end opening 146 and a circularly-shaped slot 148 and formed with notched portions defining leg retaining sections 150 and 152 is positioned on the shaft 132 in a manner such that leg retaining sections 150 and 152 are disposed between the legs 116 and 118 of the pawl member 114. The leg retaining sections 150 and 152 of the member 120 are dimensioned to retain the pawl member 114 within the chamber 138 in an asymmetrical position as more clearly hereinafter discussed. The spring 128 is formed and is disposed within the chamber 142 in a manner such that one end thereof is positioned through the opening 146 of the retaining member 120 with the other end thereof free to articulate within the slot 148 thereof.

The rotational direction changing member 122 including a centrally-formed shaft orifice 154 and a spring end opening 156 formed with an outwardly extending end member 158 is positioned on the shaft 132 such that either side portion 160 and 162 of the end member 158 are disposed between the legs 116 and 118 of the pawl member 114. The end of the spring 128 extending through the slot 148 of the retaining member 120 is positioned within the opening 156 of the member 122. The members 120 and 122 may be held on the shaft 132 of the housing member 112 by a spring loaded clip (not shown) disposed within a circularly-shaped groove (not shown) formed in the shaft 132 for ease of assembly, although not necessary to the operation of the present invention. The upraised portion 124 of the rotational direction changing member 122 is disposed within the slot 106 of the disc member 102 to permit change in the operative rotational direction of the rachet assembly, as more clearly hereinafter discussed.

A spur gear 166 is fixedly mounted over the circularly-shaped gear receiving portion 136 with a sleeve bearing 138 being mounted about the surface 136.

The gear assembly portion 94 of the drive stud and gear assembly 16 is formed with a cylindrically-shaped chamber 170 formed in coaxial alignment with the shaft passageway 98 and dimensioned to receive for unimpeded rotational movement the miter gear 24 affixed to the end 22 of the drive shaft 14. In a plane parallel to the axis of the shaft passageway 98 and co-planar with the spur gear 166, there is formed a cylindrically-shaped chamber 172 and a smaller cylindrically-shaped chamber 174 therebeneath, both chambers being dimensioned to receive a gear assembly 176 comprised of a miter gear 178 affixed to a spur gear 180 including a shaft orifice 182. The miter gear is disposed within the chamber 174 in geared relationship with the miter gear 24 with the spur gear 180 being thereby disposed within the chamber 172 in geared relationship with the spur gear 166 of the stud drive assembly 92.

An elongated cover plate 184 dimensioned to be received within a shouldered portion of the housing 90 is provided including stud drive orifice 186, a gear shaft 188 and mounting openings 190. The orifice 186 is dimensioned to receive the sleeve bearing 138 of the ratchet assembly 110 to permit of rotational movement. The shaft 188 is disposed on the cover plate 184 to permit of positioning of the gear assembly 176 within the housing 90. The cover plate 184 is mounted, such as by threaded screws 192 to the housing 90 through countersunk holes 190 rotationally inserted into threaded openings 194 of the housing 90.

As hereinbefore discussed, the springs 60 and 62 are preferably dimensioned substantially square in cross-section to provide for more contact area between the springs 60 and 62 and the surface of the end portion 26 of the drive shaft 14. Additionally, the number of turns of the spring are selected such that an excessive torque will cause a spring to slip over the end portion 26 thereby to prevent damage to the drive stud and gear assembly. Generally, a spring is selected to cause slippage when the torque exceeds about 5 foot pounds.

The frictional O-ring 52 of the present invention is important to the operation in that the frictional force generated provides the necessary torsional force to engage the spring clutch about shaft 14 so as to rotate the drive shaft 14. Absence of any such a frictional force would not permit engagement of the spring clutch assembly and thus rotational movement of the drive shaft 14 by the rotational movement of the barrel 28, and contrary wise, total fitted relationship therebetween would not result in any rotational movement of the drive shaft. Consequently, the frictional force developed by the frictional O-ring is selected to provide for at least sufficient force as to effect rotational movement of the shaft 20 up to a level of about 5 foot pounds at the stud drive 18, but would allow clutch slippage at greater loads.

Figure 6:
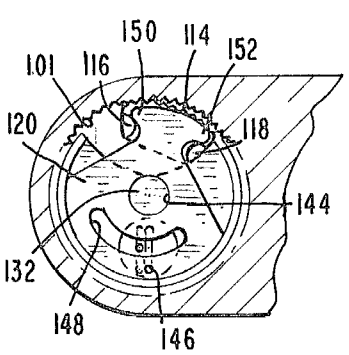
FIG. 6 is a cross-sectional view of the stud drive and gear assembly taken along the lines 6—6 of FIG. 4.
Figure 5:
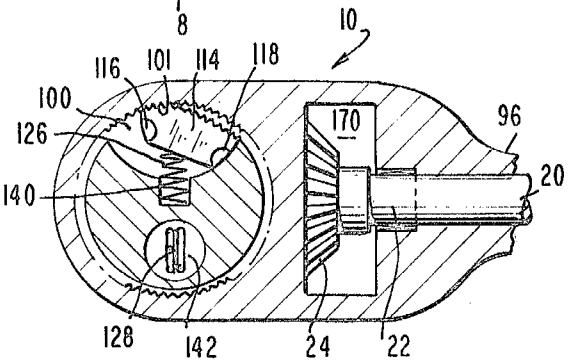
FIG. 5 is a cross-sectional view of the stud and gear assembly taken along the lines 5—5 of FIG. 4.
Figure 7:
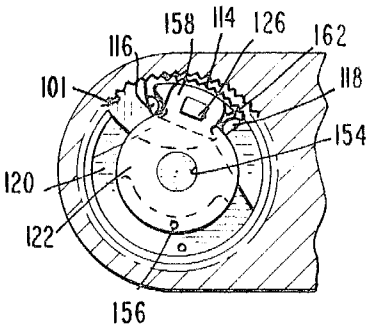
FIG. 7 is a cross-sectional view of the stud drive and gear assembly taken along the lines 7—7 of FIG. 4.
Figure 8:
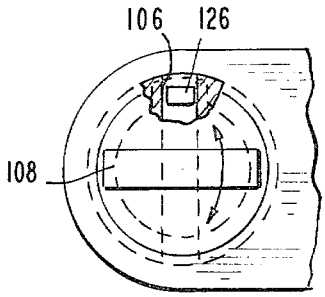
FIG. 8 is a partial bottom view of the ratchet assembly therefor.
Figure 9:
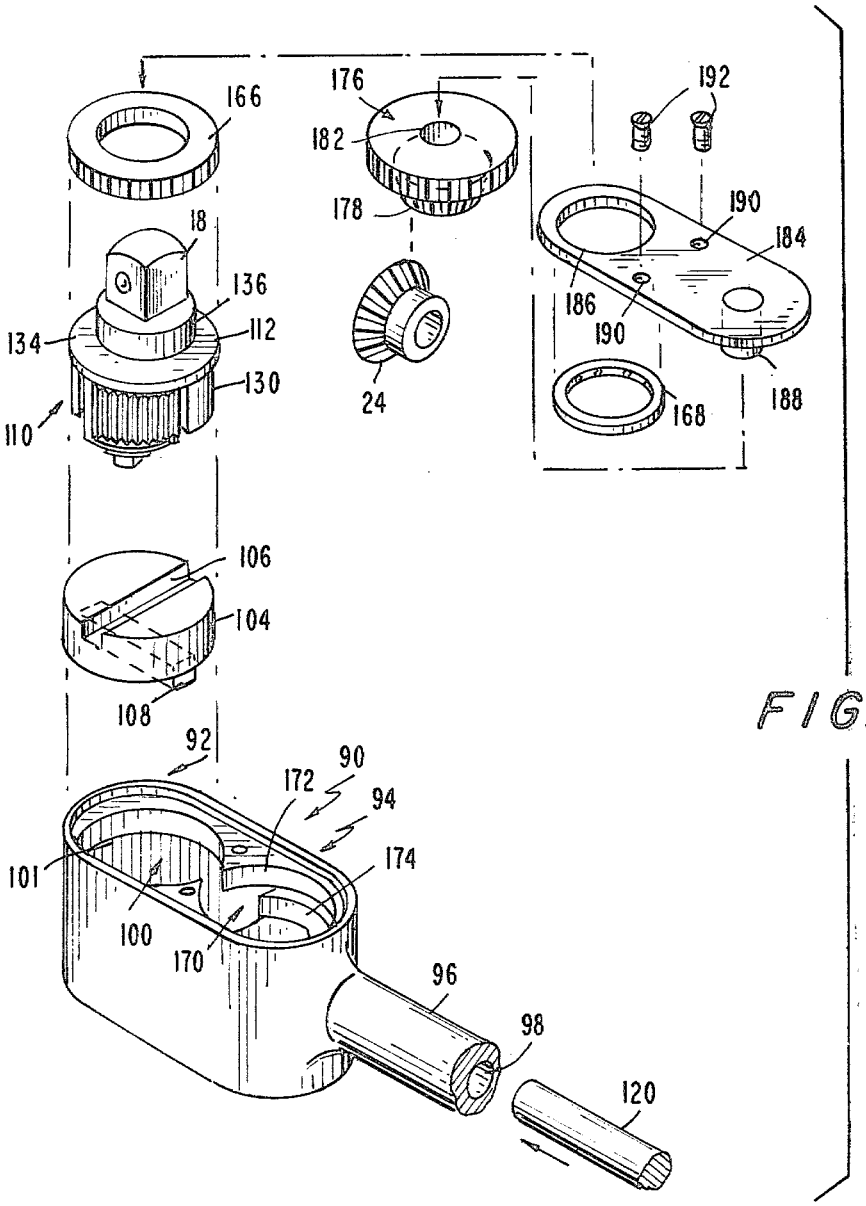
FIG. 9 is an exploded view of the stud drive and gear assembly.

In operation, the stud drive and rachet assembly of the rachet wrench assembly of the present invention functions in the manner of known rachet wrench assemblies, i.e. cranking of the assembly about an axis of a nut or bolt, depending on the configuration of the ratchet assembly, effect a drive action in one rotational direction and a ratching action in the opposite direction. In the configuration as illustrated in FIGS. 5 to 7, counterclockwise rotation will produce a drive action whereas a clockwise rotation would produce a ratcheting action. The configuration of the ratcheting assembly may be changed by turning the member 104 in a counterclockwise direction thereby causing the members 120 and 122 to similarly move against the spring force of spring 146 by movement of the raised portion 124 within the slot 106 of the member 104. Such movement of the members 120 and 122 causes portions thereof to contact the leg 116 of the pawl 114 thereby moving the pawl member 114 to the left-side portion of the chamber 138 for asymmetrical positioning therein.

Assuming positioning of the ratchet pawl 114 as illustrated in FIGS. 5 to 7 for the removal of a right hand threaded bolt (not shown) by an appropriate socket therefor (not shown) from a threaded hole therefor (not shown), counterclockwise rotation of the handle and barrel assembly about the bolt axis effects counterclockwise rotation of the bolt from the threaded hole. Clockwise rotation of the handle does not cause rotation of the bolt as long as there are frictional forces between the bolt and the threaded hole. It may be noted that during this initial phase of the loosening operation, the barrel and handle assembly move as one unit. This is due to the fact that since no attempt is being made to turn the barrel about is axis, the spring clutch assembly does not engage the shaft portion 26 of the shaft 14. Upon reaching a point where the bolt is essentially loosened, however further clockwise rotation of the handle and barrel assembly will only cause the bolt to move in reciprocal movement.

Further loosening of the bolt from the stud is effected by causing the barrel 28 to be rotated in a counterclockwise direction and thus the clamp sleeve 64 which tightens spring 60 about the shaft end 26 of the drive shaft 14 by movement of spring end **60*b* in a counterclockwise direction against the frictional drag of the O-ring 52 mounted on the spring housing 42 against the chamber 36 circumscribing inner wall of shaft housing member 32 transmitted to spring end 60*a* of the spring 60. The drive shaft 14 is thereby caused to rotate in a counterclockwise direction which counterclockwise rotational movement is transmitted to the drive stud assembly 112 by the miter gear 24, the miter gear 178, the spur gear 180 and spur gear 166, each of which are caused to rotate in a counterclockwise, clockwise, clockwise and counterclockwise direction, respectively, it being noted that the miter gear 178 and spur gear 180 are mounted to one another. It will be understood by one skilled in the art that such counterclockwise rotational movement of the barrel housing 28 simultaneously unwinds or loosens the spring 62 about the shaft end 26** although possibly transmitting a counterclockwise rotational torque by spring compression.

As readily apparent to one skilled in the art, to effect a tightening of such a bolt, clockwise rotation of the barrel effects clockwise rotation of the stud drive until a position is reached such that further clockwise rotation may be conveniently effected by the clockwise rotational movement of the handle and barrel assembly 12 about the bolt axis without any need for further clockwise rotational movement of the barrel about the drive shaft.

While the ratchet wrench assembly of the present invention is described with reference to counterclockwise rotation about the bolt axis and about the drive shaft, respectively, to effect counterclockwise rotation of a right handed bolt it is understood that the diverse variations may be employed,and in fact for special application, the ratchet wrench need include a clutch mechanism for effecting only a unirotational movement.

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

We claim:

1. A novel ratchet wrench assembly having selectable ratcheting action to rotate a drive stud in either direction which comprises: a drive stud means including a socket stud; a two-position ratchet means, a first portion to effect ratcheting action of said drive stud means in one direction and a second position to effect ratcheting action in another direction; a first gear means fixedly mounted to said drive stud means; a drive shaft including a second gear means for engaging said first gear means; a barrel structure rotatable in either of opposite directions for actuating said drive shaft; a clutch means for bi-directionally engaging and optionally driving said drive shaft in either of opposite directions responsive to rotating said barrel structure; and a handle means including said barrel structure mounted for rotation about said drive shaft whereby rotation of said barrel structure causes the barrel structure to engage said clutch means, and causes the clutch means to engage and thereby rotate said drive shaft and thus cause said drive shaft to drive said gear means which drives said stud means; said clutch means being comprised of a spring housing member, and a spring means positioned on said shaft and including two separate springs having spaced-apart first spring end portions thereof, one said first spring end portion of each of said two separate springs being in contacting relationship with the spring housing member; and said spring housing member being disposed about said spring means; said barrel structure being in engaging relationship with adjacent other second end portions of each of said two separate springs; said spring housing member being partially housed within said barrel structure; rotation force on said handle means serving to cause said barrel structure to tighten said spring means about said shaft to thereby rotate said shaft, the spring means including two helical first and second springs as said two separate springs, said first and second springs being rotatably mounted coaxially to one-another around said shaft, with said adjacent second end portions being engaged intermediately therebetween at engagement points by said barrel structure, the spring being wound in opposite directions relative to said engagement points such that rotating of the barrel structure in either of opposite rotational directions tightens helical turns of one or the other of the first and second springs and simultaneously loosens helical turns of the other remaining one of the first and second springs; and said spring housing member comprising a slot means having first and second slot-forming structure forming first and second slots at locations opposite said spaced-apart first spring end portion of each of the first and second springs, said spring housing being coaxial with said shaft and having an enlarged opening means including through-space-forming structure forming a hole in which the other adjacent ends of the first and second springs are freely movable, said enlarged opening means being disposed at a midportion of and in communication with said slot means wherein juxtaposed said other adjacent second end portions of said first and second springs are disposed within said hole and wherein said remaining first spring end portion of said first and second springs are disposed in said first and second slots respectively.

2. The ratchet wrench assembly as defined in claim 1 wherein clockwise rotation of said barrel means effects clockwise rotation of said drive stud means and wherein counterclockwise rotation of said barrel means effects counterclockwise rotation of said drive stud means.

3. The ratchet wrench assembly as defined in claim 1 wherein a rotation force about said shaft in excess of about 5 foot pounds causes slipping of said clutch means about said shaft.

4. The novel ratchet wrench assembly of claim 1, including a shaft housing member in which said drive is revolvably mounted, and said clutch means including a frictional O-ring mounted between said spring housing member and said shaft housing member in frictional engagement with each of the spring housing member and the shaft housing member sufficiently to provide a drag on the spring housing member when the barrel structure is rotated.

5. A novel ratchet wrench assembly having selectable ratcheting action to rotate a drive stud in either direction which comprises: a drive stud means including a socket stud; a two-position ratchet means, a first portion to effect ratcheting action of said drive stud means in one direction and a second position to effect ratcheting in another direction; a first gear means fixedly mounted to said drive stud means; a drive shaft including a second gear means for engaging said first gear means; a barrel structure rotatable in either of opposite directions for actuating said drive shaft; a clutch means for bi-directionally engaging and optionally driving said drive shaft in either of opposite directions responsive to rotating said barrel structure; and a handle means including said barrel structure mounted for rotation about said drive shaft whereby rotation of said barrel structure causes the barrel structure to engage said clutch means, and causes the clutch means to engage and thereby rotate said drive shaft and thus cause said drive shaft to drive said gear means which drives said stud means; said clutch means being comprised of a spring housing member, and a spring means positioned on said shaft and including two separate springs having spaced-apart first spring end portions thereof, one said first spring end portion of each of said two separate springs being in contacting relationship with the spring housing member and said spring housing member being disposed about said spring means; said barrel structure being in engaging relationship with adjacent other second end portions of each of said two separate springs; said spring housing member being partially housed within said barrel structure; rotation force on said handle means serving to cause said barrel structure to tighten said spring means about said shaft to thereby rotate said shaft.

6. The ratchet wrench assembly of claim 5, in which the spring means includes two helical first and second springs as said two separate springs, said first and second springs being rotatably mounted coaxially to one-another around said shaft, with said adjacent second end portions being engaged intermediately therebetween at engagement points by said barrel structure, the spring being wound in opposite directions relative to said engagement points such that rotating of the barrel structure in either of opposite rotational directions tightens helical turns of one or the other of the first and second springs and simultaneously loosens helical turns of the other remaining one of the first and second springs.

* * * * *